US006443615B1

(12) United States Patent
Chan

(10) Patent No.: US 6,443,615 B1
(45) Date of Patent: Sep. 3, 2002

(54) TABLE TOP DISPLAY DEVICE

(75) Inventor: Sik-Leung Chan, Tsuen Wan (CN)

(73) Assignee: C. C. & L Company Limited, Hong Kong (CN)

( * ) Notice: Subject to any disclaimer, the term of this patent is extended or adjusted under 35 U.S.C. 154(b) by 0 days.

(21) Appl. No.: 09/562,713

(22) Filed: May 2, 2000

(51) Int. Cl.[7] ..... G04B 37/00
(52) U.S. Cl. ..... 368/316; 368/276
(58) Field of Search ..... 368/10, 316–317, 368/276, 277

(56) References Cited

U.S. PATENT DOCUMENTS 2,013,575 A 9/1935 Moffatt ..... 368/316
2,125,294 A 8/1938 Iathrop ..... 368/316
6,130,861 A 10/2000 Felice ..... 368/317

*Primary Examiner*—Bernard Roskoski
(74) *Attorney, Agent, or Firm*—Alix, Yale & Ristas, LLP

(57) ABSTRACT

A travel alarm clock has a body 10 incorporating normal clock components and a clock face 13. Two covers 14 and 15 fit over the body 10 and are spring biassed to the position shown in the Figure. For travelling, the covers 14 and 15 are closed against a front and rear surface of the body 10, respectively. The covers 14 and 15 are held closed by a button release lock (not shown). If the lock is pressed, the covers are automatically opened to raise up the body 10 and hold it in the upright position shown in the Figure.

5 Claims, 5 Drawing Sheets

TABLE TOP DISPLAY DEVICE

BACKGROUND OF THE INVENTION

1. Field of the Invention

The invention relates to table top display devices.

2. Description of Prior Art

The invention can be applied to any display device, such as a digital thermometer, a picture frame, and the like, where the display device itself has protective covers for use in safe storing and transport of the device. The invention has particular application for use with travel clocks. Such clocks have been known for decades and essentially comprise a clock, nowadays usually a digital clock with alarm features for example, that is surrounded by a closable protective case. Usually the clock is also supportable in an open position on a planar surface, such as a bedside table top, with its face upright or at least clearly visible from a short distance. The arrangement is quite simply so that the clock can be safely transported from place to place and set up in various rooms visited or used by the owner of the clock. At present, it is usual that the clock is hingably connected to its protective case in a manner that allows a face cover for example to become a horizontal stand to support the clock upright for use. This requires mechanical manually manipulation to open the case and place the clock into an upright stabilised position. Although such manipulation is quite simple, some two-handed manual dexterity is usually required and the opening or "unfolding" of the case is not quite so easy in a darkened room when the user cannot see the parts very well.

SUMMARY OF THE INVENTION

It is an object of the invention to overcome or at least reduce this problem.

According to the invention there is provided a display device comprising a thin box-like body for incorporating the display device and having a front surface in which a face of the display device is mounted, a pair of covers one for the front surface and one for a rear surface of the body, in which the covers are hingably mounted adjacent the lower edge of the body and extend up over the body at the front and the back to form a protective cover for the clock, including spring biassing means to urge the covers open and respective provide a front leg and a rear leg to hold the body in an upright position, and manually releasable locking means to hold the covers closed over the body.

The body, and both the covers are preferably generally rectangular in plan.

At least one of the covers may have a rotation stop means to prevent the cover rotating beyond predetermined angle when it is opened y the spring biassing means.

The covers are preferably interleaved adjacent the said lower edge and abut against one another when the covers are biassed fully open to prevent supporting edges of the covers closing closely together when holding the body in the upright position.

A slidably releasably locking means catch may be provided for preventing release of the locking means until the catch is slid out of engagement with the locking means.

The display device may be a clock.

BRIEF DESCRIPTION OF THE DRAWINGS

A travel alarm clock according to the invention will now be described by way of example with reference to the accompanying drawings in which.

DESCRIPTION OF THE PREFERRED EMBODIMENT

Figure 1:
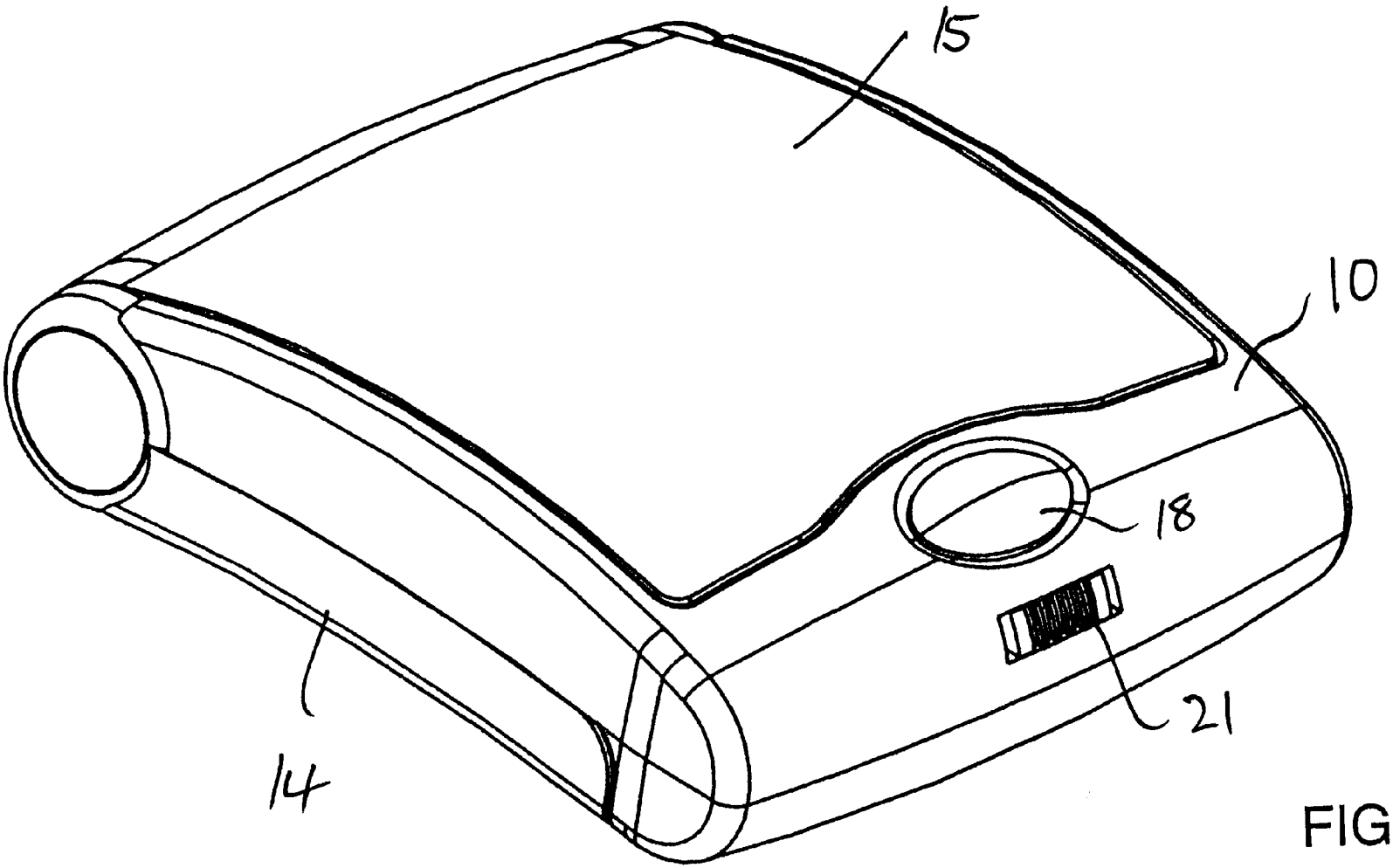
FIG. 1 is an isometric view of the clock in a closed configuration.
Figure 2:
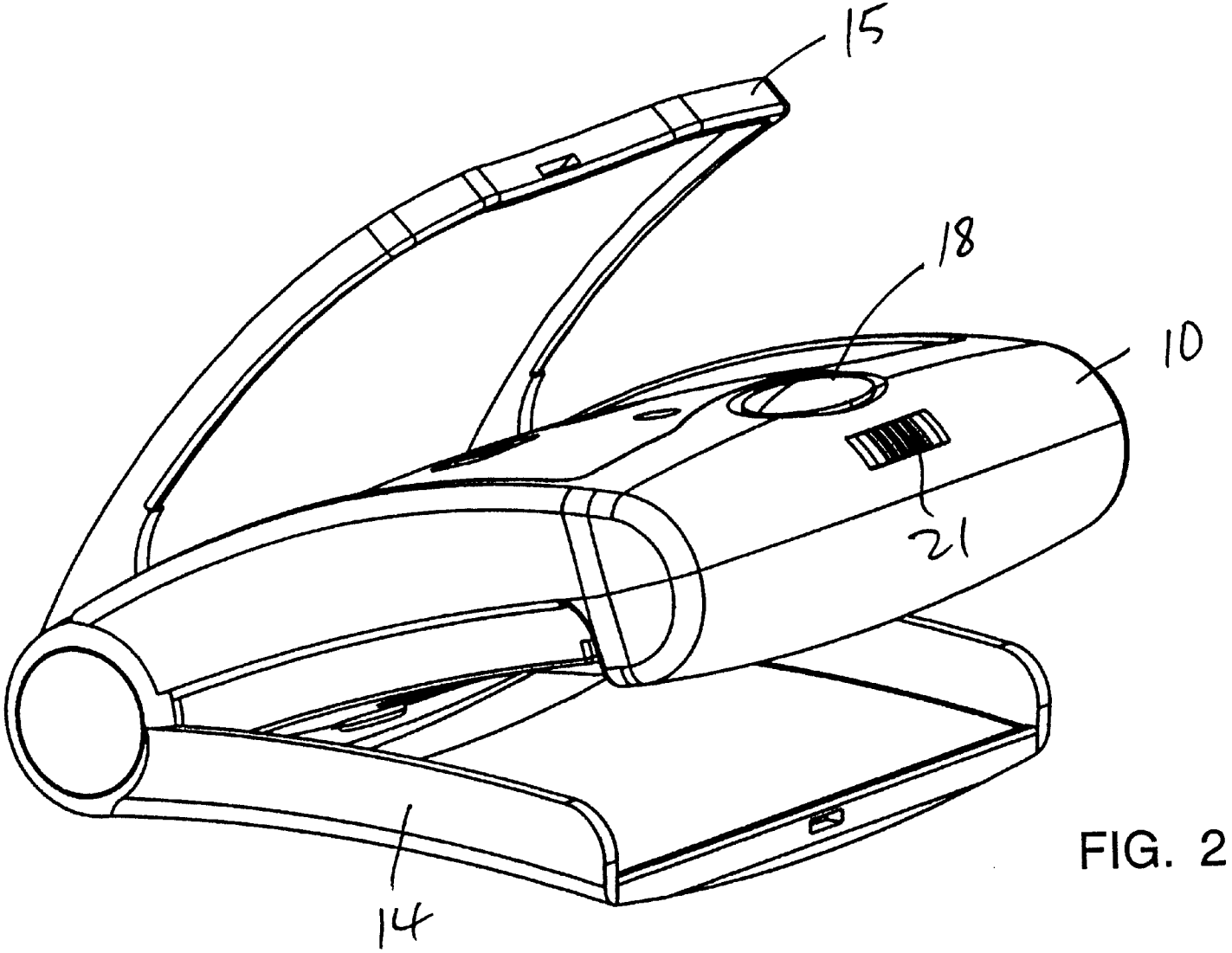
FIG. 2 is an isometric view of the clock in a first opening configuration.
Figure 3:
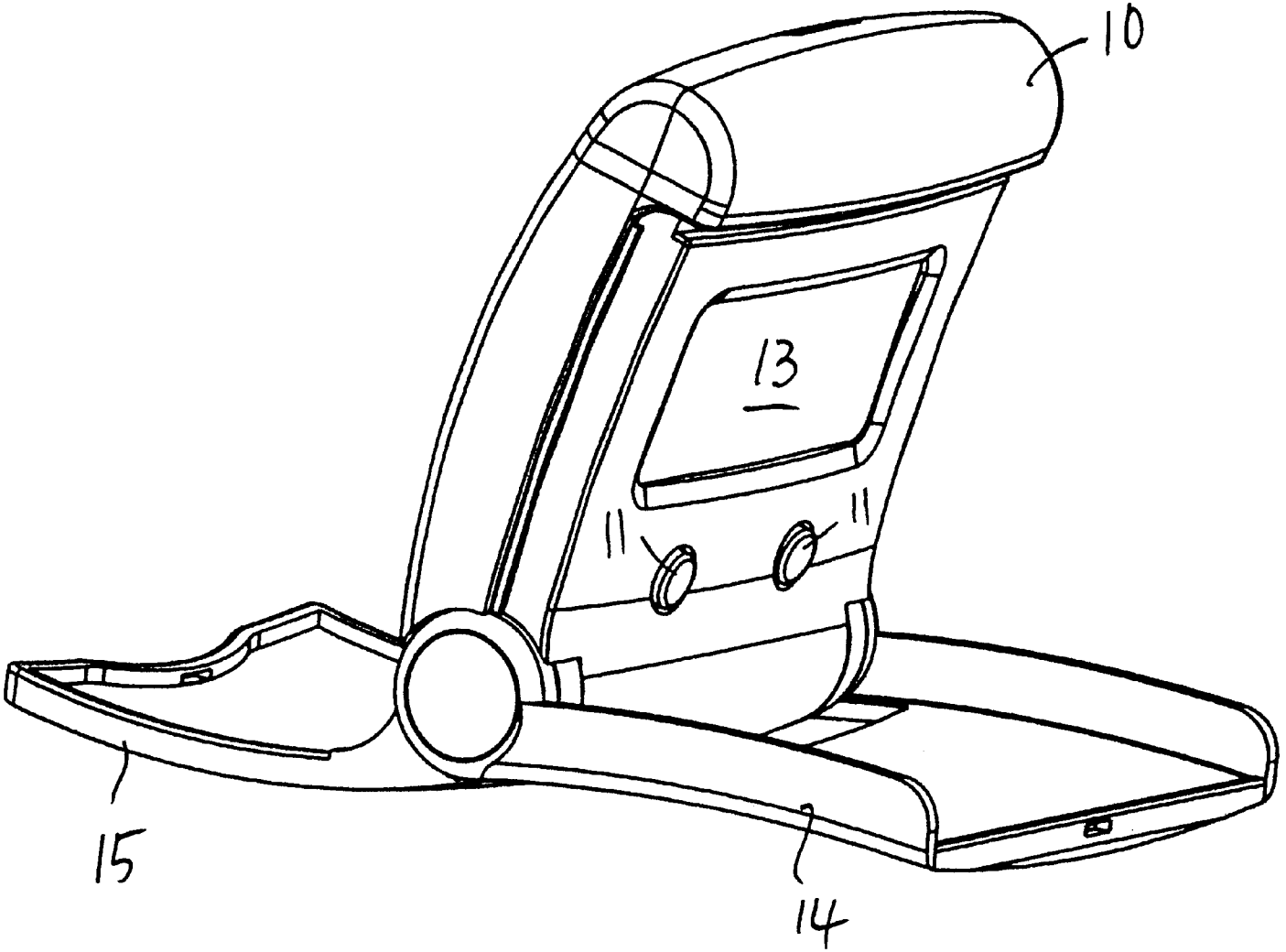
FIG. 3 is an isometric view of the clock in a second opening configuration.

Referring to the drawings, FIGS. 1 to 4 show the clock in various configurations. The clock consist of a central body 10 that incorporates the clock mechanism. The clock mechanism comprises a "standard" battery powered digital alarm clock that fits inside the body 10 and has various control buttons 11 and 12 (see FIG. 5) for setting and altering the operation of the clock, and the alarm, in a well-known manner. The clock has a face 13, or liquid crystal display, in a front surface of the body 10. A pair of covers 14 and 15, the cover 14 for the front surface of the body 10 and the cover 15 for a rear surface of the body 10, are hingable mounted to the body adjacent a lower edge of the body. The covers 14 and 15 are biassed by springs 16 and 17 to open, away from the body 10, and provide feet that hold the body 10 in an upright position (see FIG. 4).

A manually releasable lock 18 that is provided with two retaining clips 19 and 20 serves to hold the covers 14 and 15 closed, as shown in FIG. 1. A slidable catch 21 is provided to prevent the clips 19 and 20 being moved, to release the covers, by the lock 18 until the catch 21 is slid out of alignment with movement of the clips 19 and 20.

Figure 4:
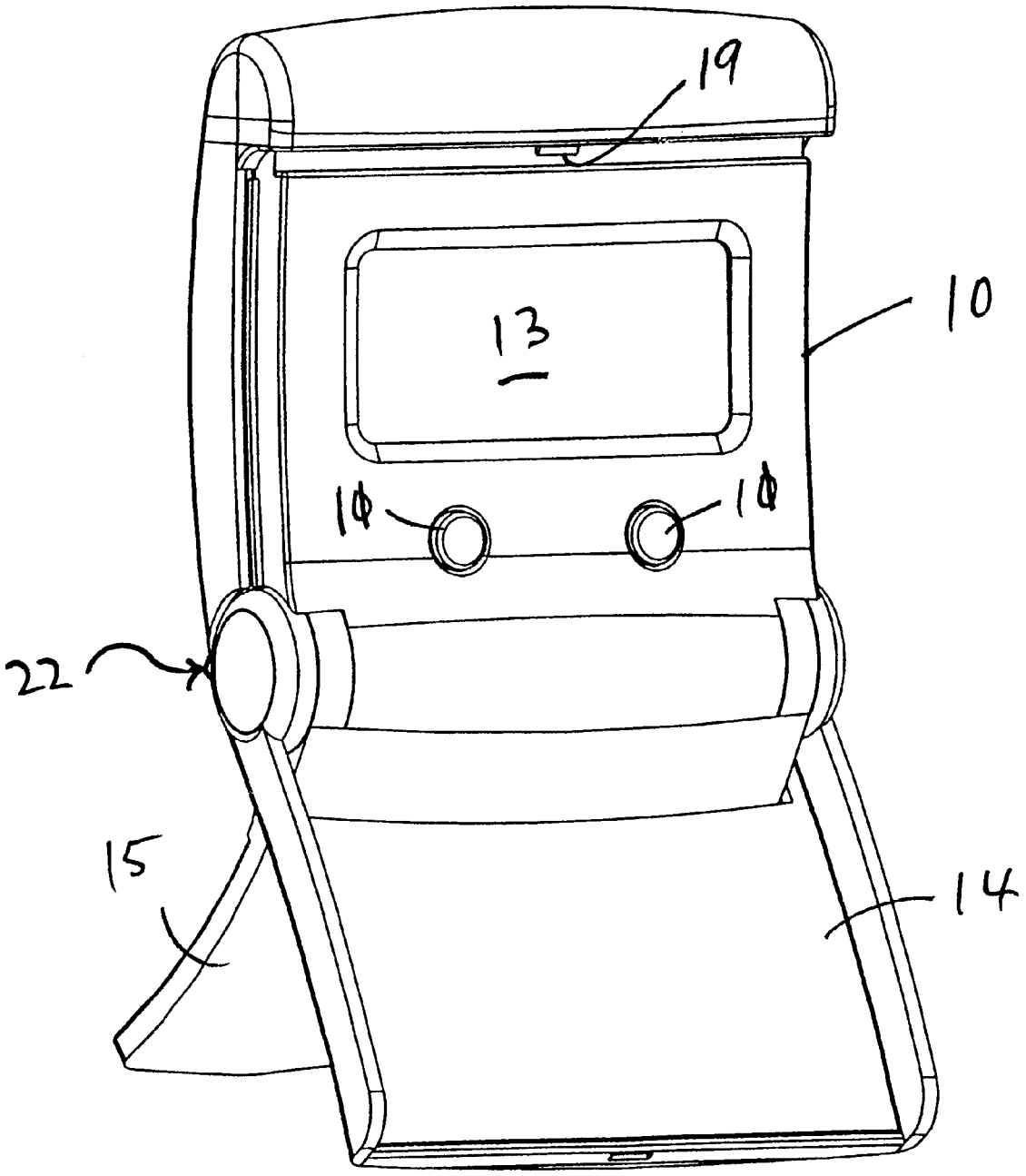
FIG. 4 is an isometric view of the clock in a fully open configuration.

For travelling, or storage, the clock is "enclosed" by the covers 14 and 15. When the clock is required for normal use, the closed clock is placed on a planar table top surface, and the catch 21 released. The lock 18 is pressed to release the covers. The springs 16 and 17 rotate the covers 14 and 15, in opposite directions, so that the covers open automatically in the sequence of FIG. 2 to FIG. 4. As a result, the body 10 is raised and held upright as shown in FIG. 4.

The opening, or "unfolding", of the clock can be arranged at any time and clearly carried out with one hand, indeed normally with one finger by pressing the lock 18. This may be done in the dark and/or when the alarm first sounds, for example early in the morning. A small light (not shown) is provided behind the screen so that as the clock opens, time displayed on the face 13 is clearly visible. It is also possible to arrange the light to switch ON when the body 10 is pressed down in FIG. 4 towards the table top surface so as to relatively rotate one of the covers 14 or 15 to some extent. A light switch electrical contact inside the body 10 is then made to illuminate the face 13. This enables the owner to check the time, visually more easily, when required, at his convenience.

It will be noted that the covers 14 and 15 are interleaved adjacent the lower edge of the body 10. In FIG. 4 it can be seen that the interleaving means that the covers abut against each other to prevent the lower supporting edges of the covers in FIG. 4 closing more closely together under the action of the springs 16 and 17. As such the support for the clock provided by the covers 15 and 16 in FIG. 4 is made more stable.

In addition, at least one of the covers 15 and 16 is provided with rotational stops 22 integrally formed on the cover 14. The stops 22 abut against the body 10 to prevent "over-rotation" of the cover 15 when the spring opens the cover, as described above.

Figure 5:
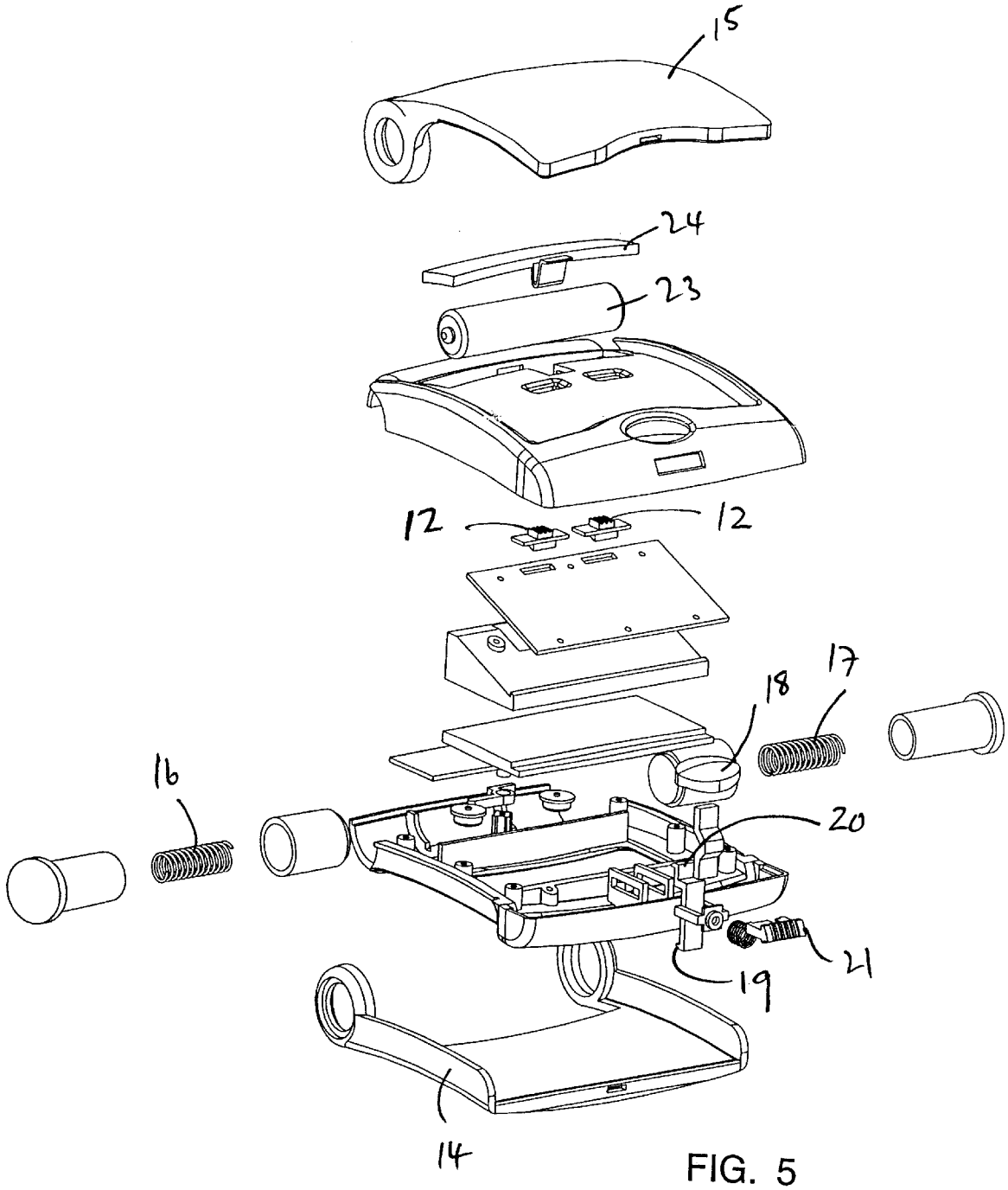
FIG. 5 is an exploded view of the clock.

FIG. 5 shows a battery 23, and a battery compartment cover 24. Other mechanical parts and fittings shown in FIG. 5 will be clear and familiar to persons skilled in the art.

The clock may be replaced by any small display device or instrument, such as a thermometer, a desk ornament or a picture frame. In all cases, the covers 14 and 15 serve to protect the device or instrument and to raise up and hold it upright automatically, under the action of the springs, whenever the covers are released.

I claim:

1. A clock display device comprising a thin box-like body for incorporating a clock and having a front surface in which a face of the clock is mounted and a rear surface, a cover for the front surface and a cover for the rear surface of the body, at least one hinge mounting said covers adjacent a lower edge of the body with each cover extending up over the body respectively at the front and the rear thereof to form a protective cover for the clock, said clock display device including spring biasing means to urge the covers open to provide a front leg and a rear leg to hold the body in an upright position, and manually releasable locking means to hold the covers closed over the body.

2. A clock display device according to claim 1, in which respective projections of the body, and both the covers into respective planes are generally rectangular.

3. A clock display device according to claim 1, in which the at least one of the covers has a rotation stop means to prevent the cover rotating beyond predetermined angle when it is opened by the spring biasing means.

4. A clock display device according to claim 1, in which the covers abut against one another when the covers are biased fully open.

5. A clock display device according to claim 1, including a slidably releasably locking means catch for preventing release of the locking means until the catch is slid out of engagement with the locking means.

* * * * *